US009346085B2

(12) United States Patent
Khani Moghanaki

(10) Patent No.: US 9,346,085 B2
(45) Date of Patent: May 24, 2016

(54) PIPE AND TUBES CLEANING MECHANISM

(76) Inventor: Mehdi Khani Moghanaki, Tehran (IR)

( * ) Notice: Subject to any disclaimer, the term of this patent is extended or adjusted under 35 U.S.C. 154(b) by 1041 days.

(21) Appl. No.: 12/826,705

(22) Filed: Jun. 30, 2010

(65) Prior Publication Data

US 2010/0263140 A1 Oct. 21, 2010

(51) Int. Cl.

| | |
|---|---|
| ***F28G 3/00*** | (2006.01) |
| ***B08B 9/045*** | (2006.01) |
| ***E03F 9/00*** | (2006.01) |
| *F28G 3/04* | (2006.01) |
| *F28G 3/10* | (2006.01) |
| *F28G 3/16* | (2006.01) |

(52) U.S. Cl.

CPC ..... *B08B 9/045* (2013.01); *E03F 9/005* (2013.01); *F28G 3/04* (2013.01); *F28G 3/10* (2013.01); *F28G 3/16* (2013.01)

(58) Field of Classification Search

CPC ..... B08B 9/045; B08B 9/049; B08B 9/053

USPC ..... 15/104.5, 104.16, 104.12, 104.14, 15/104.09, 104.03, 104.095

See application file for complete search history.

(56) References Cited

U.S. PATENT DOCUMENTS

| | | | | | |
|---|---|---|---|---|---|
| 3,436,783 | A * | 4/1969 | McCartney | ..... | 15/104.03 |
| 3,707,843 | A * | 1/1973 | Conner et al. | ..... | 60/671 |
| 3,922,746 | A * | 12/1975 | Strunk | ..... | 15/104.095 |
| 5,953,782 | A * | 9/1999 | Vogel et al. | ..... | 15/104.09 |
| 5,991,955 | A * | 11/1999 | LaNasa, Sr. | ..... | 15/104.095 |
| 6,158,074 | A * | 12/2000 | Castille | ..... | 15/88 |
| 2002/0069471 | A1 * | 6/2002 | Ornum | ..... | 15/88 |
| 2009/0193597 | A1 * | 8/2009 | Bertoldi | ..... | 15/88 |

* cited by examiner

*Primary Examiner* — Todd E Manahan
*Assistant Examiner* — Brianne Kalach
(74) *Attorney, Agent, or Firm* — Barry Choobin; Patent 360

(57) ABSTRACT

The various embodiments herein provide a mechanism for cleaning the interior surfaces of pipes/tubes. The mechanism comprises a power transfer shaft, a power generator, a power transmission means attached to the power generation means and the power transfer shaft, an electrical valve and pump, an electrical unit to generate a dynamic force, a controller for remote force controlling, a liquid guidance system integrated to the power transfer shaft, a movement conditioner for the power transfer shaft; and at least one cleaning tool removably attached to the power transfer shaft. The at least one cleaning tool includes a predefined structure to convert a turning movement of the cleaning tool into a rotational movement of the power transfer shaft for cleaning of the deposits in the pipe/tubes without any damage to an internal body of the pipe & tube.

12 Claims, 3 Drawing Sheets

PIPE AND TUBES CLEANING MECHANISM

BACKGROUND

1. Technical Field

The embodiments herein generally relates to cleaning systems and methods and more particularly relates to cleaning/de-furring systems to remove residues from inaccessible surfaces such as interior of pipes/tubes.

2. Description of the Related Art

Industrial units are invariably concerned with the issue of maintenance of equipments and machineries. Generally, the maintenance activities are launched with a purpose to enhance the output and performance of the machinery and/or to mitigate risk of probable damages as well as to increase shelf life of operating machinery.

The purpose of cleaning tanks, pipes/tubes and valves that are places for storing or passing residual fluids is fundamental as the changing level of internal section of the pipes and reservoirs is followed by frequent harmful and undesirable consequences such as reduced internal capacity of reservoirs and pipes, reduction in fluid discharges of and increased friction of the internal surfaces of the pipes and tubes.

Various preventive methods have been proposed for de-furring/cleaning the interior surfaces of pipes/tubes which are hardly accessible. These methods include chemical methods, ultrasonic methods, use of abrasive plugs and absorptive filters. However the use of such methods results in blockage of the course of the liquid and subsequent sedimentation after a while. The use of chemical materials generally harms the applied equipment and gradually looses their efficiency. Also these physical methods are not advisable in case of liquids without or with minimum sedimentary materials such as polymer and petroleum fluids.

In some other cases, mechanical cleaning systems such as water jet systems, pneumatic hydro milling and abrasive bullet are contrived for cleaning blocked pipes/tubes. However these methods have potential drawbacks. Faults/defects of these methods include impossibility of direct defurring/cleaning completely or half blocked pipes with bends thereby causing probable damage of pipes and water jets with higher pressure. Also these methods are not flexible for the existence of rigid pipes/tubes transmitting force, the breakage of drill and damage of internal casing of pipe/tubes are more likely during the smashing of stiff/hard or elastic sediments. In the meantime, as the size of water vents is too small, the vents are immediately blocked with the increased volume of sediment so that the increased in the friction and the thermal tension at the tip of means contributes to the breaking speed of the drill and damages the pipes/tubes. Since the kinetic force system could not be controlled, a small conflict, occurred at the tip of the cleaning drill with sediment, imposes a considerable tension to the tip of the instrument and causes breaking of the the tip leaving it inside the pipe/tubes, thereby distorting the defurring/cleaning function. Moreover, these tools are by no means applicable in case of half-blocked and completely-blocked pipes/tubes, hard and dendrite sediments.

Hence there exists a need to provide an improved cleaning system to clean the internal surfaces of blocked pipes/tubes irrespective of the structure of the pipe/tube. There also exits a need for a cleaning system which minimizes the blockage due to the course of liquid transfer to drill and which eliminate damage of the interior of the pipes/tubes.

The abovementioned shortcomings, disadvantages and problems are addressed herein and which will be understood by reading and studying the following specification.

SUMMARY

The primary object of the embodiments herein is to provide an improved cleaning mechanism for cleaning steady/curved half or completely-blocked pipes/tubes.

Another object of the embodiments herein is provide a cleaning mechanism based on the structure and transfer mechanism of lubricant liquid to minimize blockage on the course of liquid transfer to a cleaning tool.

Yet another object of the embodiments herein is to provide a cleaning mechanism which eliminates damage of the internal body of pipes/tubes.

Yet another object of the embodiments herein is to provide a cleaning mechanism which facilitates usage in limited spaces.

Yet another object of the embodiments herein is to provide a cleaning mechanism which is capable of removing different types of sediments.

Yet another object of the embodiments herein is to provide a cleaning mechanism which prevents the breakage of power transfer axle at the time of conflicting with hard or elastic sediments.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

The various embodiments herein provide a mechanism for cleaning the inaccessible spaces, especially inside pipes/tubes using a power transfer shaft to transfer a kinetic force of an engine to a cleaning tool. The pipe cleaning mechanism comprising a power transfer shaft, a power generator, a power transmission means attached to the power generation means and the power transfer shaft, an electrical valve and pump, an electrical unit to generate a dynamic force, a controller for remote force controlling, a liquid guidance system integral with the power transfer shaft, a movement controller for the power transfer shaft and at least one cleaning tool removably attached to the power transfer shaft. The at least one cleaning tool includes a predefined structure such that the cleaning tool is rotated due to a rotational movement of the power transfer shaft to clean the deposits in the pipe without damaging the internal surface of the pipe and the also without breaking the power transfer shaft.

According to one embodiment of the present disclosure, the predefined structure includes at least one of a triangular pattern, a pentagonal pattern and a trapezoidal pattern. The at least one of the triangular, pentagonal and trapezoidal pattern include a tip angle of 90 degree to 150 degree and a beveled section with an angle of 120 degree to 150 degrees.

According to one embodiment of the present disclosure, the cleaning mechanism includes a connection flange to connect the power transfer shaft to the power transmission means such that the power transfer shaft extends radially outwardly from the power transmission means. The connection flange is designed to connect the power transfer shaft to the power generator such that the connection flange facilitates quick isolation of the power transfer shaft from the mechanism.

According to one embodiment of the present disclosure, the power transfer shaft in connected through the intermediate mechanisms including at least one of a shaft along with a folly and belt to the power generator. The power transfer shaft comprises a body, a liquid inlet, a seal, a pulley, an axle, a liquid outlet and a ball bearing. The power transfer shaft is arranged to transfer energy generated at the power generator to the at least one cleaning tool such that the cleaning tool is turned within the pipe without breaking the power transfer axle. The power transfer shaft is made of a plurality of tensioned steel strands with a primal axle. The power transfer shaft further comprises one or more springs with at least one of an s-shaped turn and z-shaped turn along a direction of rotation of the shaft. In one embodiment, the one or more springs are made of spring steel (CrV). The power transfer shaft is a flexible and reactionary shaft with ability of curving, ringing and coiling, when not used during operation.

According to one embodiment of the present disclosure, the liquid guidance system is provided to transfer liquids from the power transfer shaft to any point between a connection place of the shaft with the power generator. The liquid guidance system is arranged to transfer liquids from a tip of the cleaning tool to an engagement site of the cleaning tool with sediments.

According to one embodiment of the present disclosure, at least one cleaning tool is a drill adapted to engage with a blocked point of the pipe. The drill is made of at least one of steel and industrial diamond with a metal coating. The cleaning drill includes one or more blades for separating polymer sediments. The cleaning tool is attached to the power transfer shaft through at least one of riveting and screwing.

According to one embodiment of the present disclosure, a controller is provided to control at least one of a rotation speed of the power transfer shaft and rejected power at the power generator.

According to one embodiment of the present disclosure, a covering is provided to obtain a secure chamber for power generation and power transmission.

These and other objects and advantages of the embodiment herein will become readily apparent from the following detailed description taken in conjunction with the accompanying drawings.

BRIEF DESCRIPTION OF THE DRAWINGS

The other objects, features and advantages will occur to those skilled in the art from the following description of the preferred embodiment and the accompanying drawings in which.

Although specific features of the embodiments herein are shown in some drawings and not in others. This is done for convenience only as each feature may be combined with any or all of the other features in accordance with the embodiments herein.

DETAILED DESCRIPTION OF THE PREFERRED EMBODIMENTS

In the following detailed description, reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a cleaning system for removing sediments or blocks from inaccessible surfaces like interiors of pipes/tubes or channels blocked by sediments or other deposits. The cleaning system, according to the embodiment herein, is preferably used for cleaning industrial pipes/tubes and oil industry equipments blocked by sediments. The cleaning system uses a power transfer shaft and by transferring a kinetic force of a power generator to the cleaning tool which rotates in accordance with the rotation of the power transfer shaft for cleaning.

Figure 1:
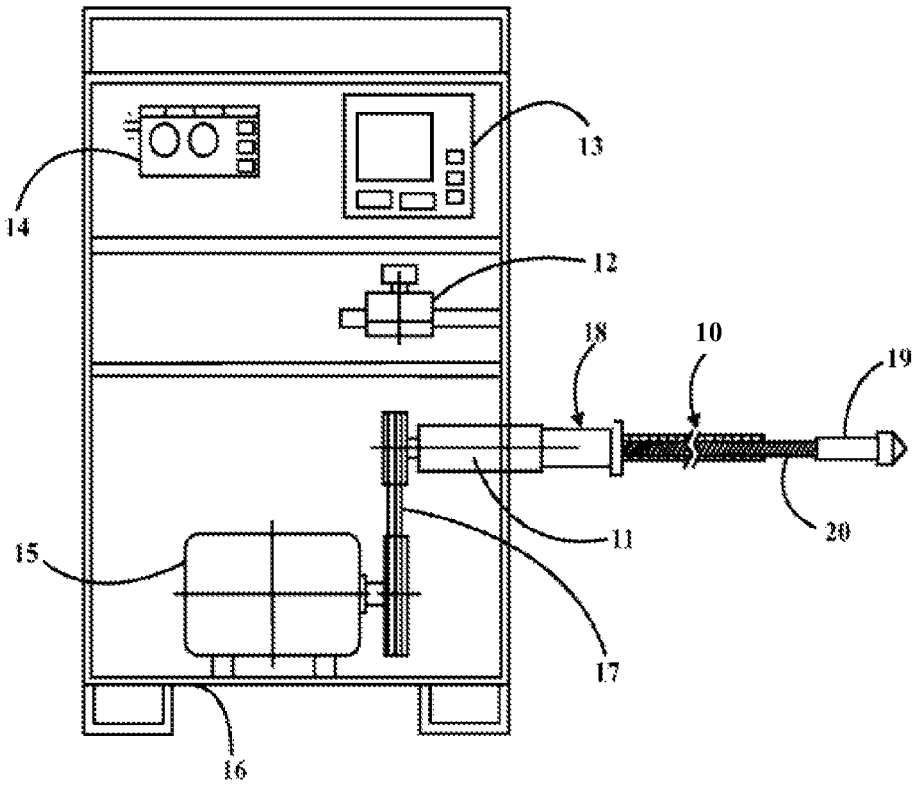
FIG. 1 is a schematic block diagram illustrating the components of a pipe cleaning mechanism according to one embodiment herein.

FIG. 1 is a schematic block diagram illustrating the components of a pipe cleaning mechanism according to one embodiment herein. The mechanism comprising a power transfer shaft 11, a power generator 15, a power transmission means 17 attached to the power generator 15 and the power transfer shaft 11, an electrical valve and pump 12, an electrical unit 14 to generate a dynamic force and a controller 13 for remote force controlling. The mechanism further comprises a liquid guidance system 18 attached to the power transfer shaft 11, a movement conditioner 10 for the power transfer shaft 11 and at least one cleaning tool 19 removably attached to the power transfer shaft 11.

The mechanism further including a covering 16 to provide a secure chamber for power generation and power transmission. The design of the covering 16 is such that it provides the possibility of installing combined system of dynamic force and liquid as well as power generator and power transfer and control systems. The covering 16 is made of rustproof metal parts like steel and peculiar designing of covering 16 results in the higher resistance and long-term application.

The power transfer shaft 11 is a flexible shaft 20 which facilitates any movement of the cleaning tool 19 within pipes without breaking the shaft 11. The power transfer shaft 11 is connected through intermediate mechanisms such as a shaft along with folly and belt to the power generator 15. The intermediate mechanism imposes minimum damage on the power transfer shaft 11. Also the output power is not limited due to the application of intermediate mechanisms and on a contrary, the power is increased twice or thrice based on the coupling or the engine speed. The power transfer shaft 11 provides for curving, ringing and coiling in off times during operations. The shaft 11 includes adequate space and length for the continuation of cleaning in long distances without occupying higher space in narrow and limited spaces. The controller 13 of dynamic force (inverter) provides for increasing or decreasing the power generation speed. This facilitates cleaning of various hard and soft sediments by adapting various speeds.

The power transfer shaft 11 is further comprised of a plurality of flexible springs which is adapted to transfer dynamic power to the tip of cleaning tool 19. The power transfer shaft 11 is composed of one or more metal or nonmetal springs 36 (shown in FIG. 3) with S-shaped or Z-shaped turns depending on the direction and kind of rotation of the shaft 11. The metal springs used herein are preferably made of spring steel (CrV). The use of springs as the power transfer shaft reduces a probable breakage of power transfer axle, reduces the possibility of coiling a long length of the shaft 11 while operating and possibility of returning power saved within spring during the engagement time of cleaning tool with the sediments. The structure of springs is such that there is a short distance between spring curls so that the force imposed on the cleaning tool 19 is saved in the spring for the torsion of the spring and is imposed again on the cleaning tool 19 in the form of circular movement of the spring in the rotating direction and this contributes to better cleaning and avoid a breakage of the power transfer shaft 11. The springs herein are preferably made of tubular wire or flat wire. Furthermore, the form of the spring used as power transfer shaft 11 contributes to the transfer of lubricant liquid to the tip of cleaning tool.

The cleaning tool 19 is adapted to engage with the blocked points of the pipes/tubes to clean the blocks or deposits. The cleaning tool 19 can be of various structures and dimensions. Generally, the cleaning tool 19 is several millimeters smaller than the diameter of the pipe subject to cleaning. The cleaning tool 19 is of nylon or metal brushes. The scale of the cleaning tool 19 is preferably in the form of a drill made of steel or industrial diamond with hard metal coating. The shape and angles of different sections of the cleaning tool is taken into consideration in the type and the rate of the sediments to be removed. With the selection of suitable angles for the cleaning tool tip, provides to generate a structure which does not allow chip-picking from the internal surface of the pipe/tubes itself avoiding damage of the internal casing of the pipe/tubes at the time of cleaning. Here, the tip angles of cleaning tool 19 based on the shapes such as trapezoidal, pentagonal and/or triangular holding two sides is 90-150° and angle of beveled sections is 120-1500.

The cleaning tool 19 further comprises furrows and bores installed to facilitate a flow of a liquid and to guide the crashed sediments to an outside area of the pipes/tubes. The cleaning tool 19 may also include two or more metal boring blades for crashing and separating polymer sediments. The cleaning tool 19 can be replaced with a brush-like element for finishing purposes after removing a layer of sediment remaining in the internal casing of the pipe/tubes. The cleaning tools 19 herein is similar to a cylinder made of metal or preferably soft composite like brass having a cutting piece at its tip made of diamond arranged with different angles and designs beside each other depending on the type and purpose of defurring/cleaning.

The cleaning tool 19 and the cleaning brush can be replaced and substituted easily with the power transfer shaft 11. The preferential designing of the cleaning tool 19 includes a design in its final section contributing to its quick connection to motion-transfer axle. Here, the cleaning tool 19 and cleaning brush is connected to the power transfer shaft through riveting or screwing.

The cleaning brush which can be installed over the mechanism includes one of a wire brush, plastic brush, string brush and polymer brush. Also the various kinds of sanding stones and polishing felts can be used based on the requirements. Another cleaning tool used in this connection is left-oriented spiral tool that can extract broken parts entrapped within the pipe/tubes for the angled and flexible axle of it.

The dynamic force generated by AC and/or DC power generator has a remote controlling capability. The remote controlling is provided by the controller 13. The controller 13 contributes to the qualitative and quantitative promotion of defurring operations and controls rotating speed of tool, rejected pressure on engine and suspension system, and the like. The power of engine is selected considering the power required for the rotation of power transfer shaft 11. Small benzene engines can be used for the manufacture of cleaning system for locations in which electric energy is not available. In such cases, the specific motion transfer systems such as PIV Gear Boxes and Frictional Motion Transfer Systems like Clutch are used for controlling the produced power. The transmission of electrical energy as well as connection of control panel is met by electric cables and circuits. In the meantime, electric valve and pump 12 placed inside the mechanism transfers water to higher elevations enabling the operator to perform cleaning operation easily and without pressure loss.

When AC power generator is used, an AC Inverter System is used as a control panel of which are in the control of the operator through electric cables, for instance, to control speed and dynamic force power at the time of cleaning. When fuel engines are used for generating dynamic force, special mechanical axles and/or frictional move transfer tools are used for controlling this power.

The flexible power transfer shaft 11 herein is made of metals, alloys, and/or polymer and composite materials holding enough resistance required for meeting system objectives. The screwing curl of the flexible power transfer shaft 11 can be changed depending on the direction and rotation type of rotation of instruments. When stiffness of the sediments and the materials considered for cleaning is high, the placing of curled cables of steel wires such as towing wire inside the spring as lining avoids excessive curling of the spring and probable breakage of the shaft 11.

The power transfer shaft 11 includes an inner case made of flexible polymers resistant against corrosion. The inner case is an empty, flexible and reactionary pipe made of anti-corrosion polyamides and polymers with different diameters. The liquid is transmitted from the inner case of the power transfer shaft 11 to any desired point between a connection place of shaft 11 with the power generator 15 and the tip of cleaning tool 19.

Figure 2:
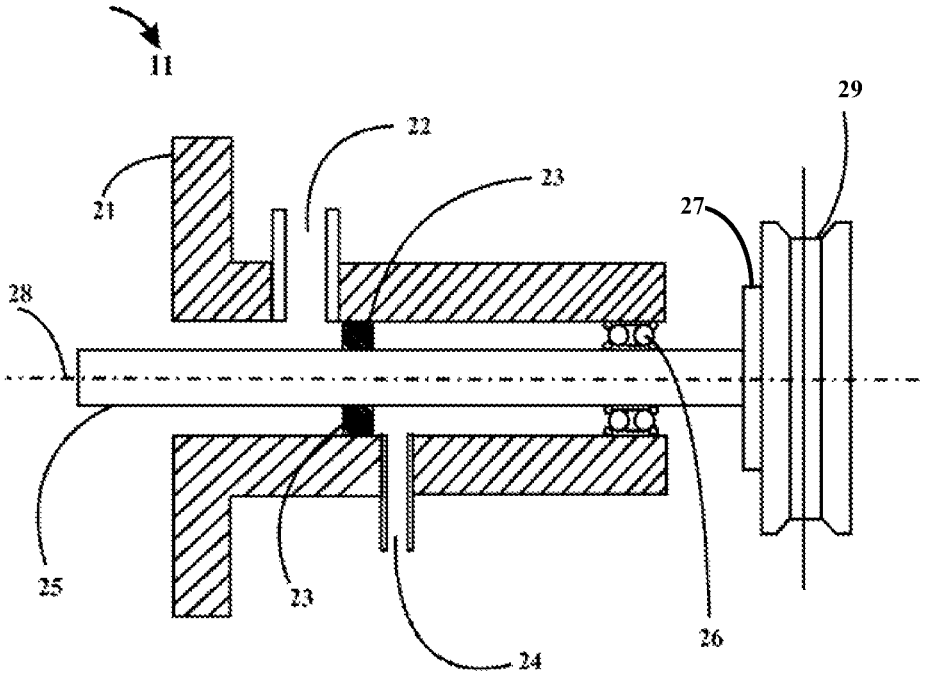
FIG. 2 is a sectional view illustrating the parts of the power transfer shaft according to one embodiment herein.

The power transfer shaft 11 is connected to the power generator 15 through a connection flange 27 (FIG. 2). The connection flange 27 of the power transfer shaft 11 is designed in the way to control a surface of the shaft 11 in itself and to prevent its rotation and leakage of water or lubricant liquid existing within the case, which is moving towards a tip of a drill, from the sides of the case. The flange 27 is also adapted to integrate a lubricant liquid with a dynamic force. A rubber boring or stuffing box and ball bearing are used inside the flange to avoid a leakage of the liquid. The diameter of the shaft 11 of the connection flange 27 is increased in the form of an incomplete cone which enables to give a shape of a trumpet tip to the end of polymer case. The connection flange 27 is designed to couple the connecting power transfer shaft 11 to the power generator 15 so as to facilitate a quick isolation of the power transfer shaft 11 from the system.

FIG. 2 is a sectional diagram illustrating parts of the power transfer shaft according to one embodiment herein. The power transfer shaft 11 includes a main body (housing) 21, a liquid inlet 22, at least two surface bushing 23, an internal flexible axle 25, a liquid outlet 24 and at least two ball bearings 26 arranged longitudinally along the axis 28 of the power transfer shaft 11. The liquid inlet 22 is provided to permit any lubricating liquid to flow through the inside of the power transfer shaft 11. In the upper side of the section related to bearings, an injection system of lubricant materials of bearings injects lubricant materials like vascasin, laevulin, water etc into the case using a pump. The liquid outlet 24 is provided for the exit of surplus water from the case thereby increasing the shelf life and the efficiency of the mechanism.

The body 21 of the power transfer shaft 11 is made of aluminum, cast iron, brass and/or any other resistant material that machine works can be practiced on them.

The power transfer shaft 11 herein is composed of at least two surface bushings 23 and an internal flexible axle 25. The surface bushing 23 is preferably an empty, flexible and reactionary pipe made of anti-corrosion polyamides and polymers with different diameters. Here the pipes are made of polyurethane having different diameters depending on the diameter of the cleaned section as surface bushing. The surface bushing 23 creates a protective layer over the power transfer shaft 11 thereby avoiding any harm to the operator. Further, the surface bushing 23 contributes to the generation of a forward force in the cleaning tool 19 and therefore the cleaning tool 19 moves forward along the pipes. This adds as an automatic forward guiding system in favor of the surface casing to regulate the removal of sediments and cleaning speed. The surface bushing 23 is also adapted to guide the liquid flow to the cleaning drill. The existence of liquid minimizes a corrosion of the internal casing of the bushing 23 by rotating the spring. There is no blockage caused in the spray section of the liquid towards the rotation space of the drill, thereby preventing the dryness and consequent breakage probability of the drill during an operation.

The power transfer shaft 11 further includes a connection flange 27 to couple the power transfer shaft 11 with the power generator 15. The connection flange 27 can be a shaft and pulley 29 with a folly and belt arrangement. The connection flange 27 is designed in a way that the pulley 29 controls an end of the surface facing the shaft 11 in itself and avoids its rotation and integrates lubricant liquid with dynamic force. The ball bearing 26 prevents leakage of water or any other lubricant liquid from sides of the case.

The power transfer shaft 11 is made of a plurality of tensioned steel strands with a primal axle. The power transfer shafts 11 is resident and powerful facilitating an installation, disassemble and practice of the required changes on it at the same place by the operator.

Figure 3:
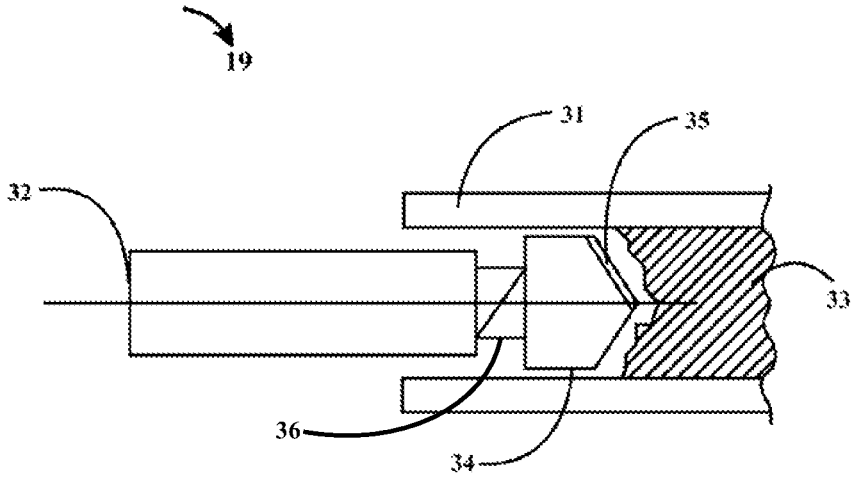
FIG. 3 illustrates a sectional view of the cleaning tool for the pipe cleaning mechanism according to one embodiment herein.

FIG. 3 illustrates a sectional view of the cleaning tool 19 for the pipe cleaning mechanism according to one embodiment herein. The cleaning tool 19 used herein is a cleaning drill which is adapted to engage with the blocked point 33 of the pipe 31. The cleaning tool 19 can have various structures and dimension. The cleaning tool 19 used, according to the embodiment herein, is a diamond drill. The diamond drill is made of industrial diamonds and is adapted to open blocked pipes 31 without generating chips.

The shape and the angles of the different sections of the cleaning tool 19 are important in the type and rate of the generated sediments. The cleaning tools 19 herein are designed such that the tip of the tools is provided with suitable angles so as to generate a structure which does not allow a chip-picking from an internal surface of the pipes at the time of cleaning.

Generally, the cleaning tool 19 is shaped as trapezoidal, pentagonal and triangular structures. The at least one of the trapezoidal, pentagonal and the triangular structure includes a tip section 35 with a predefined angle of 90-150° and a beveled section 34 with a predefined angle of 120-150°. Based on the preferential designing of the cleaning tool 19, some furrows and bores are installed on the cleaning tool 19 facilitating the flow of liquid and guidance of crashed sediments to the outside of pipes 31. Here, the cleaning tool 19 design is a single-blade type at the cleaning tool 19 tip.

According to an embodiment herein, the cleaning tool 19 is designed to provide a specific design to the end section 32 which is attached to the power transfer shaft 11 thereby enabling a quick connection or disconnection with the power transfer shaft 11. This facilitates an easy replacement of the power transfer shaft 11 when so required. Preferably, the connection of the cleaning tool/cleaning brush to the power transfer shaft 11 is done through riveting or screwing.

The cleaning tools 19 used herein is compatible with a cylinder made of metal or any other composite like brass having a cutting piece at its tip made of diamond arranged with different angles and designs beside each other depending on the type and purpose of cleaning.

According to an embodiment herein, a wire brush is used to remove the layer of sediment remaining in the internal casing of the pipes.

Based on the type, material and hardness of sediments and other factors like shape and diameter of pipe/tubes, materials and scale of the cleaning drill and its accessories can be selected by the operator. An operator, for instance, while changing the size of the tubes may adjust the tip of tools with respect to the size of the tubes. Simplicity of designing drill is one of the factors facilitating this action. This is performed when the considered tip is of precast type and may not be modified.

The embodiment disclosed herein provides a pipe cleaning mechanism which is simple and has a practical shape profile. The profile is shaped such that it does not induce any damage to the inner surface of pipes and does not permit the sediments to stick to the surface. The mechanism also facilitates the removal of different types of sediment and increases the cooling speed of the tip tool.

The embodiments herein also offer a pipe cleaning mechanism which is environment friendly and has the ability to remove sediment up to 100%. The embodiments herein disclose a pipe cleaning mechanism which is also used for the pipes of different diameters, improving the speed of pipe cleaning process and reducing the pipe cleaning time. The pipe cleaning mechanism enables the cleaning of the deposition of hard and soft elastics and provides flexibility in tubes with a specific geometric shape such as U-shape.

The embodiment herein also provides for the low energy and water consumption, reduced disaster risks and safety, repeating estimates, easy operation, possibility of use in different environmental conditions, possibility of cleaning in inaccessible areas, not damaging tubes, ability to clean completely blocked tubes, ability to clean tubes with gentle curve, a light and portable equipment, user friendly and decreased labour cost.

Although the disclosure herein is described with various specific embodiments, it will be obvious for a person skilled in the art to practice the system of the disclosure with modifications. However, all such modifications are deemed to be within the scope of the claims.

It is also to be understood that the following claims are intended to cover all of the generic and specific features of the embodiments herein and all the statements of the scope of the invention which as a matter of language might be said to fall there between.

What is claimed is:

1. A pipe and tube cleaning mechanism comprising:

a housing, the housing comprising a covering that houses:
- an electrical unit to generate dynamic force;
- a controller for remote force controlling;
- a power generator;
- an electrical valve and pump;
- and a power transfer shaft;

an intermediate mechanism attached to the power generator and the power transfer shaft, and wherein intermediate mechanism includes at least one of a shaft along with a pulley and belt;

a liquid guidance system formed integrally with the power transfer shaft;

a connection flange to connect the power transfer shaft to the intermediate mechanism such that the power transfer shaft extends radially outwards from the intermediate mechanism;

a movement conditioner for the power transfer shaft; and at least one cleaning tool removably attached to the power transfer shaft; wherein, the at least one cleaning tool includes a predefined structure such that a turning movement of the cleaning tool due to a rotational movement of the power transfer shaft provides for cleaning of a deposit in the pipe without inducing damage to an internal body of the pipe/tubes, and wherein the cleaning tool comprises furrows and bores to facilitate a flow of liquid to guide crushed sediments to an outside area of pipes and tubes, and wherein the cleaning tool is a left oriented spiral tool to extract broken parts entrapped within the pipe, and wherein the cleaning mechanism has an ability to remove sediments up to 100%, and wherein the predefined structure includes at least one of a triangular pattern, a pentagonal pattern and a trapezoidal pattern arranged at different predefined angles, and wherein the predefined angles include a tip angle of 90 degrees to 150 degrees and an angle of 120 degrees to 150 degrees at a beveled section, and wherein the at least one cleaning tool has a drill head adapted to engage with a blocked and choked point of the pipe, and wherein, the drill head is made of steel or industrial diamond with a metal coating, and wherein the cleaning tool includes at least one blade for separating polymer sediments.

2. The mechanism according to claim 1, wherein the connection flange is designed to connect the power transfer shaft to the power generator such that the connection flange facilitates a quick isolation of the power transfer shaft from the mechanism.

3. The mechanism according to claim 1, wherein the power transfer shaft comprises:

a main body provided with a liquid inlet;

at least two surface bushings, and wherein the at least two surface bushings create a protective layer over the power transfer shaft thereby avoiding any harm to an operator, and wherein the at least two surface bushings generates a forward force in the cleaning tool to move the cleaning tool forward along the pipe to regulate a removal of the sediments and a cleaning speed, and wherein the at least two surface bushings guide a liquid flow to the cleaning tool; an internal flexible axle;

a liquid outlet; and at least two ball bearings.

4. The mechanism according to claim 1, wherein the power transfer shaft is adapted to transfer an energy generated at the power generator to the at least one cleaning tool such that the cleaning tool is turned within the pipe without breaking the power transfer shaft.

5. The mechanism according to claim 1, wherein the power transfer shaft is made of a plurality of tensioned steel strands with a primal axle.

6. The mechanism according to claim 1, wherein the power transfer shaft further comprising:

one or more springs with at least one of an s-shaped turn and z-shaped turn along a direction of rotation of the power transfer shaft.

7. The mechanism according to claim 6, wherein the one or more springs is CrV steel spring.

8. The mechanism according to claim 1, wherein the power transfer shaft is a flexible and reactionary shaft with ability of curving, ringing, coiling in off times during operation.

9. The mechanism according to claim 1, wherein the liquid guidance system provides for a transfer of the liquids from the power transfer shaft to any point between a connection places of the shaft with the power generator and a tip of the cleaning tool.

10. The mechanism according to claim 1, wherein the liquid guidance system provides for transfer of liquids from a tip of the cleaning tool to an engagement site of the cleaning tool with sediments.

11. The mechanism according to claim 1, wherein the cleaning tool is connected to the power transfer shaft through at least one of riveting and screwing means.

12. The mechanism according to claim 1, wherein the controller is adapted to control at least one of a rotation speed of the power transfer shaft and reject power at the power generator.

* * * * *